US005232039A

United States Patent [19]

Shapiro et al.

[11] Patent Number: 5,232,039

[45] Date of Patent: Aug. 3, 1993

[54] WINDOW DRESSING SYSTEM FOR A PLEATED DRAPE OR THE LIKE

[75] Inventors: David R. Shapiro, Glenview; Harry Shapiro, Skokie, both of Ill.

[73] Assignee: Shapco Inc., Glenview, Ill.

[21] Appl. No.: 860,668

[22] Filed: Mar. 30, 1992

Related U.S. Application Data

[63] Continuation-in-part of Ser. No. 498,445, Mar. 22, 1990, abandoned, which is a continuation of Ser. No. 851,221, Apr. 14, 1986, abandoned.

[51] Int. Cl.[5] ..... A47H 1/00

[52] U.S. Cl. ..... 160/330; 160/38

[58] Field of Search ..... 160/330, 345, 348, 38, 160/39, 123, 124, 126; 16/87.4 R, 87.2, 94 D, 94 R, 95 D, 95 R, 96 D, 96 R

[56] References Cited

U.S. PATENT DOCUMENTS

| | | | |
|---|---|---|---|
| 2,683,891 | 7/1954 | Rosenbaum . | |
| 2,824,606 | 2/1958 | Lorentzen | 160/38 |
| 2,848,735 | 8/1958 | Ault et al. . | |
| 3,095,033 | 6/1963 | Polkosnik | 160/345 |
| 3,155,150 | 11/1964 | Silvestre | 160/348 |
| 3,178,760 | 4/1965 | Kalal et al. . | |
| 3,247,893 | 4/1966 | Ford | 160/345 |
| 3,297,075 | 1/1967 | Howell et al. . | |
| 3,344,463 | 10/1967 | Znamirowski | 16/94 D |
| 3,361,190 | 1/1968 | Snyder . | |
| 3,369,589 | 2/1968 | Benkert, Jr. . | |
| 3,378,879 | 4/1968 | Stall . | |
| 3,424,225 | 1/1969 | Magnusson | 160/345 |
| 3,434,524 | 3/1969 | Fein | 160/345 |
| 3,435,876 | 4/1969 | Toti . | |
| 3,497,905 | 3/1970 | Pflum | 160/126 X |
| 3,682,226 | 8/1972 | Ford | 160/330 |
| 3,871,082 | 3/1975 | Pflum | 16/87.2 |
| 3,883,924 | 5/1975 | Grabman | 160/126 X |
| 3,927,437 | 12/1975 | Ford | 160/345 X |
| 3,975,792 | 8/1976 | Janson | 16/87.4 R |
| 4,014,071 | 3/1977 | Janson . | |
| 4,079,770 | 3/1978 | Woodle . | |
| 4,114,233 | 9/1978 | Hamilton | 160/38 X |
| 4,120,474 | 10/1978 | Hurley | 16/96 D X |
| 4,124,918 | 11/1978 | Cummings . | |
| 4,230,171 | 10/1980 | Baker, Sr. . | |
| 4,374,536 | 2/1983 | Becker | 160/84.1 |
| 4,546,809 | 10/1985 | Hadfield | 160/126 |
| 4,662,421 | 5/1987 | Basmadji et al. . | |
| 4,828,002 | 5/1989 | Ashby . | |
| 5,144,997 | 9/1992 | Marasco et al. | 160/38 X |

FOREIGN PATENT DOCUMENTS 1135141 8/1962 Fed. Rep. of Germany .

*Primary Examiner*—David M. Purol

*Attorney, Agent, or Firm*—Foley & Lardner

[57] ABSTRACT

The present invention provides a window dressing system which, according to one aspect of the invention, has a bracket for supporting a drapery on one side and a window treatment on the other side. The bracket is configured with tracks which cooperate with movable hardware assemblies attached to the top window treatment and the drapery in a manner that provides simple and efficient removal of the window treatment and the drapery for servicing. The drapery hardware assembly is also designed to facilitate pleating of the drapery in an easy to assemble and disassemble arrangement.

21 Claims, 3 Drawing Sheets

WINDOW DRESSING SYSTEM FOR A PLEATED DRAPE OR THE LIKE

CROSS REFERENCE TO COPENDING APPLICATION

This is a continuation-in-part of application Ser. No. 07/498,445, filed Mar. 22, 1990 now abandoned, which was a continuation of application Ser. No. 06/851,221 filed Apr. 14, 1986 now abandoned.

Technical Field

The present invention relates generally to a window dressing system and more particularly to a window dressing system for creating and thence carrying a pleated drape and a top window treatment.

BACKGROUND OF THE INVENTION

Window dressing systems are typically used for decorative purposes around a window as well as for blocking light entering a room from it. These systems usually include a drape having hooks or carriers which can be movably engaged with a track mounted over a window along a wall. The draperies can be slid back and forth along the track to a position that allows a desirable amount of light to enter a room through the window. Numerous devices, such as wands or cords and pulley arrangements, can be used to slide the carriers back and forth along the track when adjusting the position of the draperies to a desired location.

Often, it is desirable to provide draperies with pleats to give them a more decorative and appealing look. Pleating, however, usually requires a more complicated system of carrier tracks and carriers. Additionally, pleats formed in the draperies can make cleaning more difficult. This problem is compounded since pleated draperies are also more difficult and time consuming to mount once they have been cleaned due to the added complexity of the carriers and track system.

Carriers have at times been made with separable fasteners to simplify removal of the draperies. Fasteners, such as snap fasteners, have been used to connect draperies to the carrier elements so the draperies may simply be separated from the carrier elements and the track by unsnapping the fasteners. However this method has presented additional problems in the form of inadvertent loosening of the draperies from the carriers. For instance, moving the draperies too rapidly, brushing up against the draperies, or simply the weight of the draperies themselves often caused such snap fasteners to become unfastened at unwanted times.

With window dressing systems, it is often desirable to use a top window treatment, such as a valance or cornice. Such a window treatment decoratively covers the top region of the draperies as well as any mechanisms such as tracks or carriers. Using a top window treatment, however, also adds to the complexity of the window dressing system since additional brackets are necessary to hold the treatment over the top region of the draperies without obstructing their longitudinal movement. In the past, various brackets and fasteners have been used to mount these additional top window treatments, but those brackets and fasteners have presented problems due to the added complexity as well as the added difficulty and expense involved in assembling the components on site and mounting the window dressing system along a wall. Additionally, removal and cleaning of those window treatments have been difficult and time consuming.

The present invention addresses the foregoing drawbacks of known drapery systems.

SUMMARY OF THE INVENTION

The present invention provides a window dressing system for creating and thence carrying a pleated drapery or the like and a separate top window treatment in spaced relationship from a wall, or other supporting structure, proximate a window to be covered or framed by the drapery. The window dressing system, according to one aspect of the invention, includes a bracket having an inner face for disposition toward the wall, an outer face for disposition away from the wall, and a longitudinal axis for disposition generally parallel to and spaced from the wall. The bracket also includes a set of preferably two track members located on opposite sides of the longitudinal axis from each other. The first track member extends interiorly of the bracket, adjacent the inner face, and is configured to receive window drapery hardware in sliding engagement therewith for supporting the top region of the drapery. The second of the track members extends exteriorly of the bracket, adjacent to the outer face, and is configured to receive top window treatment hardware to support the top window treatment which conceals the window dressing system from view. The bracket also includes an anchoring element for receiving mounting hardware which secures the bracket to a wall.

A standard is disposed in operative engagement with the bracket at the anchoring element and secures the bracket to the wall. The standard also functions to space the bracket from the wall and to create a longitudinal pleat zone between the bracket and the wall within which the drapery may move between its opened and closed positions.

Positioned at each end of the bracket and disposed generally normal to the longitudinal axis are first and second return members which extend inwardly of the bracket into proximity with the wall. These first and second return members close the opposing ends of the pleat zone. Each of the return members includes at least one retaining clip for receiving and restraining the terminus of the top window treatment and preferably a second such clip for the drapery as well.

According to a further aspect of the invention, glide tape is attached to the drape proximate its upper end. The glide tape includes a flexible linear web which is secured to the drapery generally congruent with the longitudinal axis. A plurality of glide elements are preferably permanently affixed to the flexible web and are disposed along it in a linear spaced array so that each of the glide elements projects outwardly of its plane. Each glide element is formed with a geometry generally complementary to the geometry of the first track member so that the glide tape may be slidingly engaged therewith for reciprocable travel in the direction of the longitudinal axis. This glide tape is most preferably combined with pleating tape, which has a spaced array of apertures wherein the interaperture spacing is less than the interelement spacing of the glide elements. This pleating tape, when disposed over the glide tape, creates and maintains pleats in the drape even when the drape is fully extended. The combination of components makes this window dressing system easy to assemble, disassemble or mount on a wall.

BRIEF DESCRIPTION OF THE DRAWING

The invention will hereafter be described with reference to the accompanying drawing, wherein like numerals denote like elements, and.

DETAILED DESCRIPTION OF PREFERRED EMBODIMENTS

Figure 1:
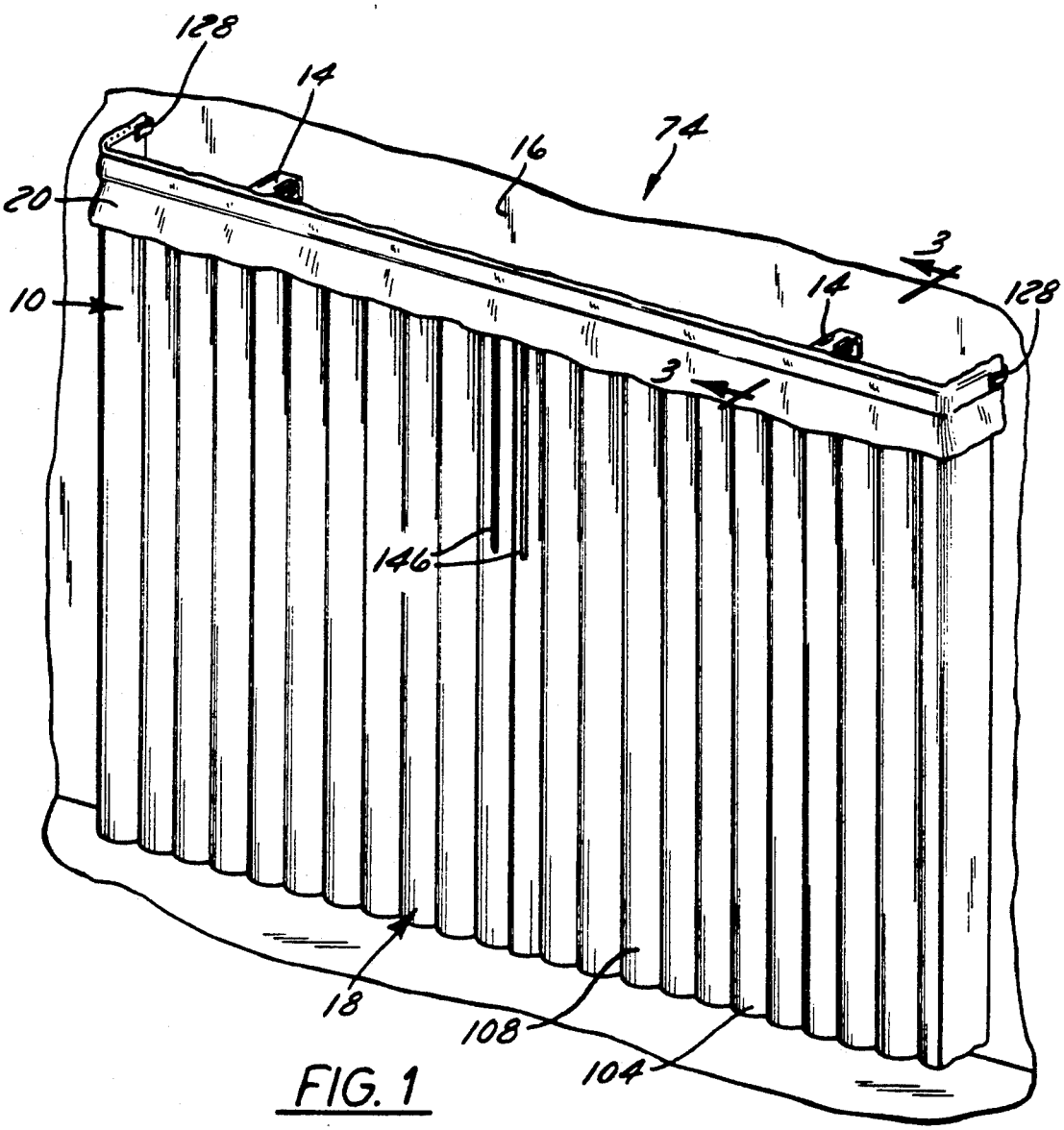
FIG. 1 is a perspective view of a window dressing system according to the invention.
Figure 2:
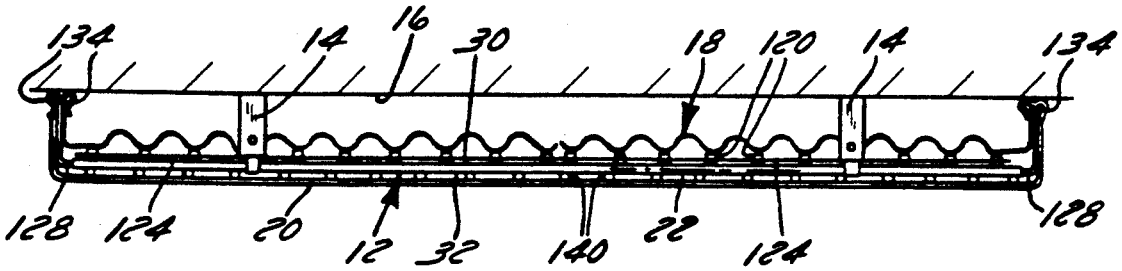
FIG. 2 is a schematic top view, showing the pleated drape top window treatment mounted on the drapery bracket.

Referring now to the figures of the drawing, a window dressing system designated generally as 10 is shown to include a bracket 12, a pair of standards 14 for affixing it to a wall 16, a drapery hardware assembly 17 for supporting a pleated drapery 18 between the bracket and the wall, and top window treatment hardware assembly 19 for supporting a top window treatment 20. The window dressing system 10 is designed to create a pleated pattern in the drapery material and permit the drapes to open and close in front of a window (not shown) while maintaining the desired pleated configuration.

The window dressing system 10 is typically mounted along a wall in a position which will allow pleated drapery 18 to be selectively extended to cover a window in varying degrees, thus allowing the desired amount of light to pass through the window and into a room. Bracket 12 is usually disposed above the window to support the drapes and is generally long and narrow, having a longitudinal axis 22 which preferably runs parallel to wall 16.

Figure 6:
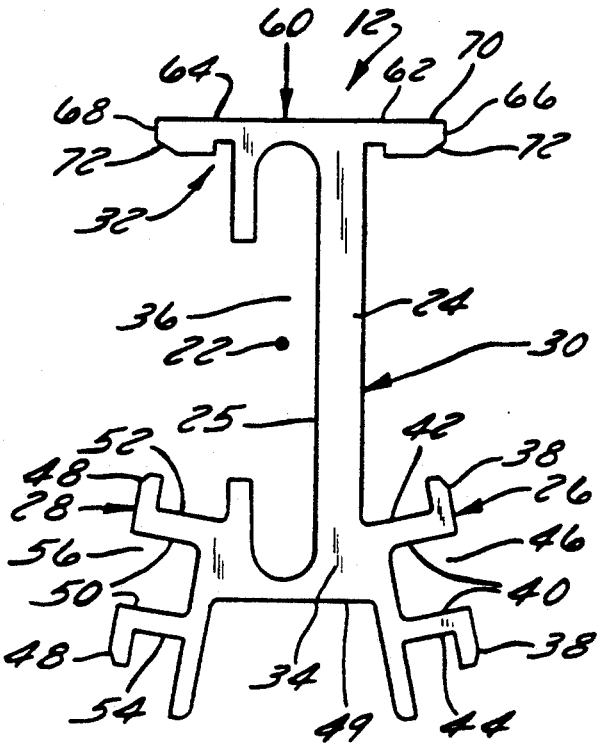
FIG. 6 is a cross-sectional view taken generally along line 6—6 in FIG. 5.

Bracket 12, best viewed in FIG. 6, is shown to include an inner face 24 disposed toward wall 16 and an outer face 25 disposed away from the wall. An inner track member 26 and an outer track member 28 are located on opposite sides of a central web 30 of the bracket. Inner track member 26 extends interiorly of bracket 12 and inner face 24 and is configured to receive window drapery hardware 17 in sliding engagement therewith for supporting drapery 18. Outer track member 28 extends exteriorly of bracket 12 adjacent outer face 25 and is configured to receive top window treatment hardware 19 to support top window treatment 20 for concealing window dressing system 10 from view.

Figure 5:
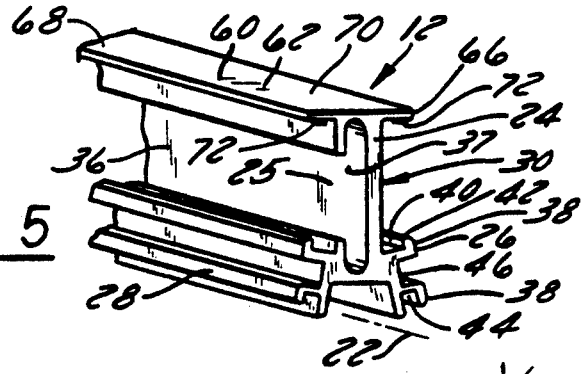
FIG. 5 is a perspective view of an end of the window dressing system bracket.

In the preferred embodiment, illustrated in FIG. 6, central web 30 extends in the direction of longitudinal axis 22 and is generally rectilinear in overall cross-section with the longer sides oriented in the vertical direction. Central web 30 extends between an upper flange member 32 and track members 26 and 28, both disposed at a first or lower end 34 of web 30, to define an intermediate longitudinal slot 36. Slot 36 extends all the way along bracket 12 congruent with longitudinal axis 22, terminating at a pair of openings 37 disposed at the longitudinal ends of central web 30, as best viewed in FIG. 5.

Preferably, first end 34 is on the lower side of bracket 12 when bracket 12 is mounted to wall 16. The set of track members, 26 and 28, extend interiorly and exteriorly from central web 30, respectively, at first end 34. Inner track member 26 includes a generally vertical flange 38 spaced from web 30 by a base track 40, preferably comprised of an upper track 42 and a lower track 44 separated by a channel 46. Flange 38 is disposed at the distal end of base track 40 and extends perpendicular to base track 40 and away from channel 46 on both sides. Similarly, outer track member 28 includes a generally vertical flange 48 spaced from web 30 by an arm 49 extending outwardly and merging into a base track 50. The base track 50 preferably includes an upper track 52 and a lower track 54 separated by a channel 56. Flange 48 is disposed at the distal end of base track 50, extending perpendicular to base track 50 and away from gap 56 on both sides.

In an alternative embodiment, track members 26 and 28 each may have a general T-shape configuration which includes a single base track member from which extend an upper and lower flange, wherein the base of the inner track member T is attached to central web 30 and the base of the outer track member T is attached to extended portion 49. In such an embodiment, there is no channel corresponding to 46 or 56.

In the illustrated embodiment, bracket 12 also includes an anchoring element 60 for receiving a mounting hardware assembly 61. Anchoring element 60 is preferably disposed at a second or upper end 62 on an opposite side of central web 30 from the inner and outer track members described above. In a preferred embodiment, best viewed in FIG. 6, anchoring element 60 includes an arm 64 extending beyond central web 30 and disposed generally perpendicular to the wall on which window dressing system 10 is to be mounted. Anchoring element 60 includes an inner edge 66 which lies generally parallel with longitudinal axis 22 on the interior side of central web 30. Anchoring element 60 also includes an outer edge 68 which lies generally parallel with longitudinal axis 22 and is disposed to the exterior of central web 30. A generally flat upper surface 70 extends between inner edge 66 and outer edge 68. Extending beneath plate 70 are a pair of shoulders 72, one of each lying adjacent inner edge 64 and outer edge 66, respectively. Shoulders 72 extend generally parallel to longitudinal axis 22 and facilitate the mounting of bracket 12 to standards 14.

Mounting bracket 12 is preferably secured to a wall at a spaced distance to form a longitudinal pleat zone 74 disposed between the wall and the bracket. Longitudinal pleat zone 74 provides a space so that pleated drapery 18 may be suspended from bracket 12 and hang between the wall and bracket 12.

Standard 14 is disposed in operative engagement with bracket 12 at anchoring element 60. In the preferred embodiment, best viewed in FIGS. 1 and 3, there are a pair of standards 14. Each standard is comprised of a narrow, flat body member 76 and a wall attachment end 78 connected to the body member for affixing standard 14 to a wall. Standard 14 further comprises a bracket connection end 80 to which bracket 12 may be mounted. Wall attachment end 78 preferably includes a wall mount flange 82 which extends at approximately 90° from body member 76 and preferably includes a plurality of holes 84. Standards 14 may be affixed to a wall by any convenient means such as fasteners which are known in the art, like screws 86.

Bracket connection end 80 is formed to receive mounting hardware assembly 61 which slidably engages a surface, preferably the bottom surface, of bracket connection end 80 and body member 76. Body member 76 preferably includes a pair of slots 90 to which mounting hardware assembly 61 can be attached and selectively positioned by a fastener 92, preferably a simple bolt-and-nut. The fastener 92 extends through mounting hardware 61 and slot 90 to hold mounting hardware assembly 61 against body member 76. Preferably, the fastener is one which can be loosened and tightened so that the distance between bracket 12 and wall 16 (and thus the lateral dimension of pleat zone 74) can be adjusted by sliding fastener 92 along slot 90.

In a preferred embodiment, mounting hardware assembly 61 includes a flat bar 94 having a fastener end 96 through which fastener 92 extends and a mounting end 98 which engages anchoring element 60. Preferably, mounting end 98 terminates in a hook 100 which extends across upper surface 70 of anchoring element 60 and around outer edge 68 and the outer shoulder 72. A cam 102 is rotatably connected to bar 94 between the hook 100 and fastener end 96. Cam 102 is disposed so that when hook 100 curls around outer edge 68 and shoulder 72, cam 102 may be rotated under inner edge 64 and inner shoulder 72 to frictionally engage central web 30, thus securely fixing bracket 12 between hook 100 and cam 102. Once bracket 12 is securely fastened to the mounting hardware assembly 61, the width of longitudinal pleat zone 74 can be adjusted simply by moving fastener 92 to a different location along slot 90.

Pleated drapery 18 hangs from bracket 12 in longitudinal pleat zone 74. It is ordinarily comprised of a web of material 104 having a top region 106 attached to bracket 12 and a bottom region 108 disposed away from bracket 12. Web 104 also preferably includes a front face 110 and a rear face 112. Web 104 may be comprised of a single sheet of material, such as a fabric web, or a plurality of sheets, each suspended from bracket 12.

Figure 3:
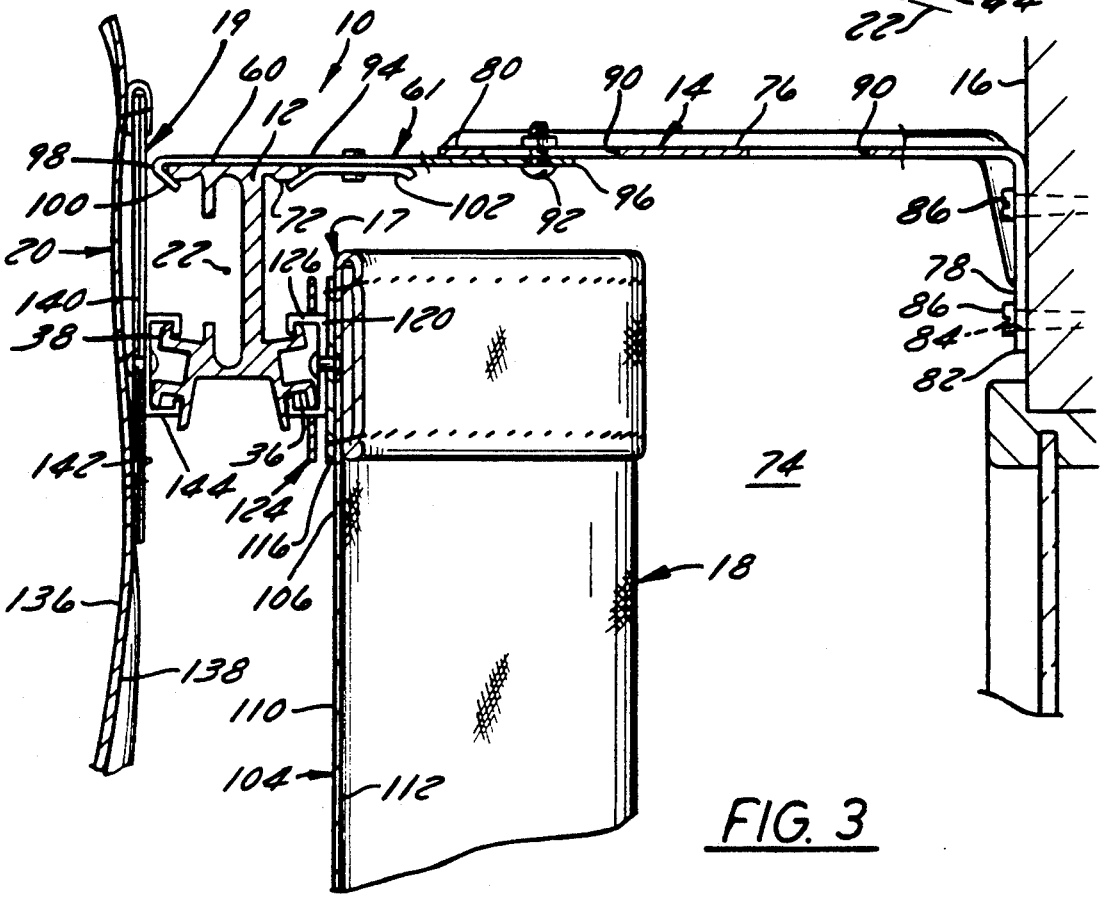
FIG. 3 is a cross-sectional view taken generally along the line 3—3 in FIG. 2.
Figure 4:
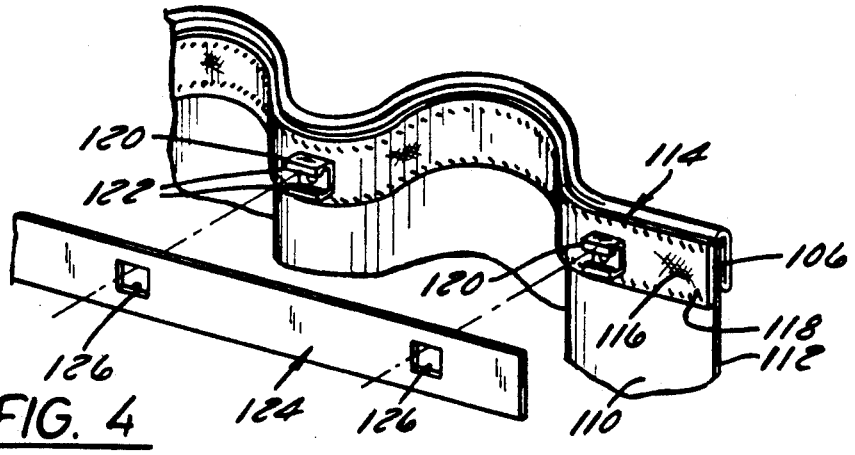
FIG. 4 is an exploded view showing the glide tape and the pleating tape.

Window drapery hardware assembly 17 is mounted along top region 108, as best viewed in FIGS. 3 and 4. It connects drapery 18 to inner track member 26 and allows the drapery to move in a longitudinal direction along bracket 12. Preferably, the window drapery hardware 17 comprises a glide tape 116, which is attached to drapery 18 proximate the upper edge thereof along substantially its entire length. Glide tape 116 is formed from a flexible linear web 118 carrying a plurality of glide elements 120 projecting outwardly of the plane of flexible web 118 in a spaced linear array. In the preferred embodiment, glide tape 116 is secured to the drapery material by sewing it or by adhesively bonding it thereto. Glide elements 120 are formed with a reentrant geometry generally complementary to the geometry of inner track member 26 so that glide tape 116 may be slidingly engaged therewith for reciprocable travel in the direction of longitudinal axis 22.

Glide elements 120 can be affixed to flexible linear web 118 in numerous ways known in the art, although the use of rivets is preferred. In a preferred embodiment, best viewed in FIG. 3, glide elements 120 are each generally C-shaped in cross-section and include a pair of retainer elements 122 which extend towards each other at the open end of the "C". The general C-shape of glide elements 120, including retainer elements 122, allows glide elements 120 to be snapped over inner track flanges 38 of inner track member 26 by spreading the open end of the "C" and snapping the glide elements over the flanges 38, thus facilitating longitudinal movement along track member 26. Once glide elements 120 are connected to inner track member 26, either by sliding them over an end of inner track member 26 or by snapping them over the track flanges 38, transverse movement away from inner track member 26 is prevented by the interference between flanges 38 and retainer elements 122.

Pleating tape 124 is preferably used in cooperation with glide tape 116 to preserve a pleated appearance in drapery 18, even when drapery 18 is spread out along longitudinal axis 22 to its maximum extent. Pleating tape 124, shown in FIG. 4, is a flexible web having a spaced array of apertures 126 wherein the interaperture spacing is less than the intermember spacing between glide elements 120 on flexible linear web 118. Pleating tape 124 is disposed over glide tape 116 with at least some (and preferably all) sequential glide elements 120 projecting through at least some (and once again preferably all) sequential apertures 126 of pleating tape 124.

Apertures 126 are designed to fit over glide elements 120 to prevent top region 106 and thus drapery 18 from being extended to a completely flat or planar configuration. To maintain cooperation between the pleating tape and the glide elements, pleating tape 124 is placed over glide elements 120 before they are connected to inner track member 26. Pleating tape 124 is captured between flexible linear web 118 and inner track member 26 and engagement with glide elements 120 is maintained. This establishes and maintains the pleated configuration of the finished drapery product.

Figure 7:
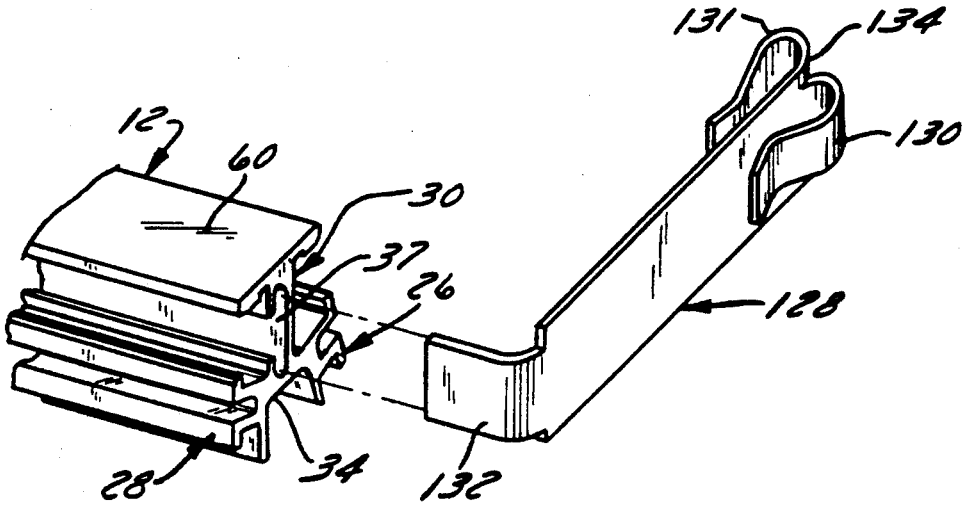
FIG. 7 is an exploded view showing an end of the bracket and a return member.

First and second return members 128, one of each located at each longitudinal end of bracket 12, are disposed generally normal to longitudinal axis 22. Return members 128, shown in detail in FIG. 7, extend inwardly of bracket 12, toward wall 16, and into proximity with the wall to close the opposing ends of pleat zone 74. Each return member has a retaining clip 130 for receiving and restraining the terminus of top window treatment 20 as best viewed in FIG. 1. In the preferred embodiment, a similar clip 131 is provided on the interior side to restrain the drapery.

The return members 128 are preferably made from a generally flat, stiff plastic material which extends between the longitudinal ends of bracket 12, proximate openings 37, and wall 16. Each return member 128 has a lip 132 configured to engage slot 37 of bracket 12. Preferably, lip 132 is lightly press fit into slot 36 so that the resistance will maintain the engagement between them. So positioned, return members 128 prevent glide elements 120 from sliding off the longitudinal ends of inner track 26, ensuring that drapery 18 remains completely suspended from inner track 26 and, by securing the ends of the drape and top window treatment, provide a finished look. However, if drapery 18 needs to be removed from inner track 26, possibly for cleaning, one of the return members 128 can simply be pulled loose from opening 37 so that glide elements 120 and drapery 18 can be moved longitudinally past the end of inner track 26.

Top window treatment 20 is supported on outer track member 28, preferably to conceal bracket 12 and window drapery hardware assembly 17 from view. Top window treatment 20 is usually a decorative facade which may take many forms including that of a valance or cornice, so it may be soft or rigid. As best viewed in FIG. 3, a decorative surface 136 is exposed to view and a backing surface 138 is disposed towards bracket 12. Hardware assembly 19 is affixed to backing surface 138 to attach top window treatment 20 to bracket 12. Preferably, window treatment hardware assembly 19 includes a mounting tape 140 having a flexible base layer 142 and a plurality of glide members 144 geometrically configured for engagement with outer track member 28. Glide members 144 are preferably similar to glide elements 120 used to suspend the drapery 18 from inner track member 26. Glide members 144 thus facilitate removal of the top window treatment 20 from outer track member 28 for servicing such as cleaning.

Mounting tape 140 is of sufficient stiffness to provide support for the window treatment 20 particularly when window treatment 20 is made from a cloth material. Glide members 144 are preferably affixed to base layer 142 by rivets and extend from base layer 142 in a direction away from backing surface 138. In an alternative embodiment, base layer 142 may be interchanged or supplemented with shirring tape which allows a cloth window treatment to be permanently and tightly pleated in an appealing configuration. Regardless, it is preferred to stiffen the top window treatment if it is not made from a rigid material so it will retain its shape, projecting suitably above and below the bracket 12 to hide it and the associated hardware from view.

Unless removed, top window treatment 20 remains stationary when mounted on outer track member 28. Drapery 18, however, is configured for longitudinal movement along longitudinal axis 22. Drapery 18 may be moved along inner track member 26 by a variety of ways which are known in the art including simply sliding it by hand. However, a wand 146 can be attached to drapery 18 as shown in FIG. 1. Simply by moving the wand, the drapery can be moved back and forth along bracket 12. Other systems, such as a traverse system using pulleys and an associated cord are well known in the art and can also be used to move drapery 18.

Window dressing systems are commonly known and come in many different shapes and combinations. However, the present invention provides a novel advancement in its unique combination of elements which provide a dependable system which is easy to use and install.

Drapery 18 is equipped with glide elements which are securely fastened to the drapery so that the drapery will not come loose from bracket 12. There is no risk that separable fasteners will be lost or broken when drapery 18 is removed for cleaning. The glide elements allow drapery 18 to be simply slid from inner track 26 when removed. Since the pleats formed result from pleating tape, there are no permanent or semi-permanent pleats in drapery 18 to interfere with the removal or cleaning of the drapery. Reinstalling the drapery is just as simple since the glide elements are merely slid over track 26 and a return member 128 is pressed in place to hold drapery 18 in pleating zone 74.

Top window treatment 20 is just as easily installed or removed from bracket 12. Glide members 144 are preferably permanently attached to top window treatment 20 so that the top window treatment can easily be slid onto or removed from outer track 28.

The unique combination of components and their secure interconnection also facilitates shipping and mounting of the window dressing system along a wall. The completed or partially completed system can be shipped intact. Thus, the installer can simply fasten standards 14 of the ready-made window dressing system to a wall.

It will be understood that the foregoing description is of preferred exemplary embodiments of this invention, and that the invention is not limited to the specific forms shown. For example, the inner and outer track members as well as the cooperating glide elements and glide members can use different configurations which will allow longitudinal movement while preventing transverse movement of the drapery. Additionally, various systems for imparting motion to the drapery may be used and different configurations or return members may be used. These and other modifications may be made in the design and arrangement of the elements without departing from the scope of the invention as expressed in the appended claims.

What is claimed is:

1. A window dressing system for carrying a pleated drape and a separate top window treatment in spaced relationship from a wall or the like proximate a window to be covered or framed by said drape, said system comprising:

a.) a bracket having an inner face for disposition toward a wall, an outer face for disposition away from said wall and a longitudinal axis for disposition generally parallel to and spaced from said wall, a set of track members, one of each located on opposite sides of said longitudinal axis, the first of said track members extending towards said wall interiorly of said bracket from said inner face and configured to receive window drapery hardware in sliding engagement therewith for supporting the top region of said drape generally between said bracket and said wall, and the second of said track members extending exteriorly of said bracket adjacent said outer face and configured to receive top window treatment hardware to support said top window treatment for concealing said window dressing system from view, and an anchoring element for receiving mounting hardware to secure said bracket to said wall;

b.) at least one standard disposed in operative engagement with said bracket at said anchoring element, for securing said bracket to said wall and spacing said bracket therefrom sufficiently to create a longitudinal pleat zone therebetween;

c.) first and second return members, one of each located at each end of said bracket and disposed generally normal to said longitudinal axis, extending inwardly of said bracket toward and into proximity with said wall to close the opposing ends of said pleat zone, each of said return members having at least one retaining clip for receiving and restraining the terminus of said top window treatment.

2. The window dressing system of claim 1, wherein said first and second track members lie generally on the same horizontal plane.

3. The window dressing system of claim 2, wherein said bracket has a central rigid web and said first and second track members are comprised of generally vertical flanges separated from said rigid web on opposite sides and at a first end thereof.

4. The window dressing system of claim 3, wherein said anchoring element is comprised of a flange at a second end of said rigid web.

5. The window dressing system of claim 1, wherein each of said return members includes a second retaining clip for receiving the terminus of said drape.

6. A window dressing system for carrying a pleated drape and a separate top window treatment in spaced relationship from a wall or the like proximate a window to be covered or framed by said drape, said system comprising:

a.) a bracket having an inner face for disposition toward a wall, an outer face for disposition away from said wall and a longitudinal axis for disposition generally parallel to and spaced from said wall, a set of track members, one of each located on opposite sides of said longitudinal axis, the first of said track members extending interiorly of said bracket adjacent said inner face and configured to receive window drapery hardware in sliding engagement therewith for supporting the top region of said drape, and the second of said track members extending exteriorly of said bracket adjacent said outer face and configured to receive top window treatment hardware to support said top window treatment for concealing said window dressing system from view, and an anchoring element for receiving mounting hardware to secure said bracket to said wall;

b.) at least one standard disposed in operative engagement with said bracket at said anchoring element, for securing said bracket to said wall and spacing said bracket therefrom sufficiently to create a longitudinal pleat zone therebetween;

c.) first and second return members, one of each located at each end of said bracket and disposed generally normal to said longitudinal axis, extending inwardly of said bracket toward and into proximity with said wall to close the opposing ends of said pleat zone, each of said return members having at least one retaining clip for receiving and restraining the terminus of said top window treatment, wherein said first and second track members lie generally on the same horizontal plane; said bracket has a central rigid web and said first and second track members are comprised of generally vertical flanges separated from said rigid web on opposite sides and at a first end thereof; and said anchoring element is comprised of a flange at a second end of said rigid web, further wherein the window dressing system comprises a glide tape for attachment to said drapery proximate the upper end thereof, said glide tape having a flexible linear web to be secured to said drape generally congruent to said longitudinal axis and a plurality of glide elements disposed along said flexible web in a linear spaced array having an intermember spacing, each of said glide elements projecting outwardly of the plane of said flexible web and being formed with a reentrant geometry generally complementary to the geometry of said first track member so said glide tape may be slidingly engaged therewith for reciprocable travel in the direction of said longitudinal axis.

7. The window dressing system of claim 6, further comprising pleating tape formed with a spaced array of apertures therein having an interaperture spacing, wherein the interaperture spacing is less than the intermember spacing of said glide elements, said pleating tape being disposed over said glide tape with at least some of the glide elements sequentially projecting through at least some of the apertures therein, the interaperture spacing being selected to create pleats in a drape of said system.

8. The window dressing system of claim 7, wherein said glide elements are generally C-shaped and include a retainer element which interferes with said vertical flange on said first track member to limit the transverse movement of said glide element with respect to said first track member.

9. The window dressing system of claim 7, wherein said standard further comprises a mounting hardware assembly having a hook disposed over said flange of said anchoring element and a cam which engages said rigid web to maintain said hook in rigid engagement with said flange.

10. The window dressing system of claim 9, wherein said standard includes a slotted body portion to which said mounting hardware assembly is adjustably attached by a fastener extending through said slotted body portion to facilitate adjustment of said bracket with respect to the wall.

11. The window dressing system of claim 7, further comprising drapery movement means for opening and closing the same upon sliding movement of said glide members on said first track member.

12. The window dressing system of claim 11, wherein said movement means is comprised of a wand secured within said system.

13. The window dressing system of claim 11, wherein said movement means is comprised of a traverse system and associated cord.

14. The window dressing system of claim 7, wherein said top window treatment is comprised of a valance.

15. The window dressing system of claim 7, wherein said top window treatment is comprised of a cornice.

16. The window dressing system of claim 7, further comprising a mounting tape secured to said top window treatment, defining means for securing said top window treatment to said second track member.

17. The window dressing system of claim 16, wherein said mounting tape flexibly supports a cloth valance.

18. The window dressing system of claim 16, wherein said mounting tape includes a base layer and a plurality of glide members projecting outwardly of the plane of said base layer and being formed with a geometry generally complementary to the geometry of said second track member so said mounting tape may secure said top window treatment to said second track member.

19. The window dressing system of claim 8, wherein said glide elements are permanently affixed to said flexible linear web and said flexible web is permanently affixed to said drapery.

20. The window dressing system of claim 7, wherein said window treatment is comprised of a shirring tape secured to said top window treatment, said shirring tape having a plurality of glide members permanently affixed to it.

21. The window dressing system of claim 7, wherein each of said track members comprises an upper track and a lower track separated by a channel, said upper track and said lower track having flanges extending away from said channel.

* * * * *